US007758151B2

(12) United States Patent
Yamamoto

(10) Patent No.: US 7,758,151 B2
(45) Date of Patent: Jul. 20, 2010

(54) WIPER DEVICE AND LIQUID EJECTION APPARATUS

(75) Inventor: Taisuke Yamamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 860 days.

(21) Appl. No.: 11/652,601

(22) Filed: Jan. 12, 2007

(65) Prior Publication Data

US 2007/0159508 A1 Jul. 12, 2007

(30) Foreign Application Priority Data

Jan. 12, 2006 (JP) ..... 2006-005034

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 5,610,641 A 3/1997 Ikado
6,164,754 A * 12/2000 Ide et al. ..... 347/33
2007/0115318 A1 5/2007 Nishizaki et al.

FOREIGN PATENT DOCUMENTS

| | | | |
|---|---|---|---|
| JP | 07-137270 A | | 5/1995 |
| JP | 2000-006437 A | | 1/2000 |
| JP | 2001-260383 A | | 9/2001 |
| JP | 2004-299299 A | | 10/2004 |
| JP | 2004299299 A | * | 10/2004 |
| JP | 2007076294 | | 3/2007 |

* cited by examiner

*Primary Examiner*—Stephen D Meier
*Assistant Examiner*—Alexander C Witkowski
(74) *Attorney, Agent, or Firm*—Sughrue Mion, PLLC

(57) ABSTRACT

A wiper device wipes a nozzle surface of a liquid ejection head along a wiping direction. The nozzle surface has a plurality of nozzle openings for ejecting liquid and step. The steps are located outside of the area in which the nozzle openings are provided and extend along the wiping direction. The wiper device includes a wiper member that wipes the nozzle surface along the wiping direction. The wiper member has a first portion corresponding to the steps and a second portion corresponding to the area in which the nozzle openings are arranged. Wiping force for wiping the nozzle surface of the first portion is greater than that of the second portion.

12 Claims, 3 Drawing Sheets

WIPER DEVICE AND LIQUID EJECTION APPARATUS

CROSS-REFERENCE TO RELATED APPLICATIONS

This application is based upon and claims the benefit of priority from prior Japanese Patent Application No. 2006-005034, filed on Jan. 12, 2006, the entire contents of which are incorporated herein by reference.

BACKGROUND

The present invention relates to wiper devices and liquid ejection apparatus.

Inkjet type printers (hereafter simply referred to as printers) are widely known as liquid ejection apparatuses that eject ink (liquid) onto a target from a recording head, or a liquid ejection head having a plurality of nozzles. After having been ejected, the ink may adhere to a portion in the vicinity of nozzle openings. Also, after having been ejected, ink may be splashed by a target (for example, recording medium, such as a sheet of paper), thus adhering to a nozzle surface of the recording head. Ink adhered to the nozzle surface can cause offset ejection of ink droplets or clogging of the nozzles. This leads to printing problems. In order to solve these problems, printers are typically provided with a wiper device that wipes the nozzle surface of the recording head, thereby cleaning the nozzle surface.

This type of printer has a cap holder that covers the nozzle surface of the recording head to prevent the recording head from being dry. A wiping device includes a rubber wiper member that is selectively raised and lowered relative to the cap holder. In wiping operation, the vertical position of the wiper member is controlled such that the distal end (upper end) of the wiper member overlaps the nozzle surface by an amount of approximately 1 mm. The recording head is moved horizontally relative to the wiper member. The relative movement causes the distal end (upper end) of the wiper member to be flexed and slide on the nozzle surface of the recording head. Accordingly, ink on the nozzle surface is wiped off.

A typical recording head has a box-like head case attached to the lower surface of a carriage, and a rectangular nozzle plate provided on the lower surface of the head case. JP-A-2001-260383 discloses a configuration in which the edge of at least one of the four sides of a nozzle plate is supported from below by a support portion of a head cover so that the nozzle plate does not come off the head case.

The support portion of the cover head forms a step on the nozzle surface disclosed in JP-A-2001-260383. Thus, when the wiper member wipes the nozzle surface, ink adhered about the step is not sufficiently removed. That is, some ink remains unwiped on the nozzle surface.

To permit the wiper member to wipe off the ink in an area including the step on the nozzle surface, it may be effective to increase the rigidity of the wiper member and the urging force with which the wiper member is pressed against the nozzle surface. In this case, however, the pressing force by which the wiper member is pressed against the nozzle surface can be excessively increased. The wiper member can thus remove water-repellent plating on the nozzle surface (particularly, the plating in an area including the nozzle openings). Also, the sliding resistance between the wiper member and the nozzle surface can be excessively great, which increases the driving load for moving the recording head and the wiper member relative to each other.

SUMMARY

Accordingly, it is an objective of the present invention to provide a wiping device and a liquid ejection apparatus that readily and reliably wipe a nozzle surface with a step.

To achieve the foregoing objectives and in accordance with one aspect of the present invention, a wiper device that wipes a nozzle surface of a liquid ejection head along a wiping direction is provided. The nozzle surface has a plurality of nozzle openings for ejecting liquid and step. The steps are located outside of the area in which the nozzle openings are provided and extend along the wiping direction. The wiper device includes a wiper member that wipes the nozzle surface along the wiping direction. The wiper member has a first portion corresponding to the steps and a second portion corresponding to the area in which the nozzle openings are arranged. Wiping force for wiping the nozzle surface of the first portion is greater than that of the second portion.

In accordance with another aspect of the present invention, a liquid ejection apparatus that includes a liquid ejection head and a wiper member is provided. The liquid ejection head has a nozzle surface. The nozzle surface has a plurality of nozzle openings for ejecting liquid and a step. The steps are located outside of an area in which the nozzle openings are provided and extend along a predetermined direction. The wiper member wipes the nozzle surface along a wiping direction parallel with the predetermined direction. The wiper member has a first portion corresponding to the steps and a second portion corresponding to the area in which the nozzle openings are arranged. Wiping force for wiping the nozzle surface of the first portion is greater than that of the second portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

An inkjet printer, which is a type of liquid ejection apparatus, according to a first embodiment will now be described with reference to FIGS. 1 to 4B.

Figure 1:
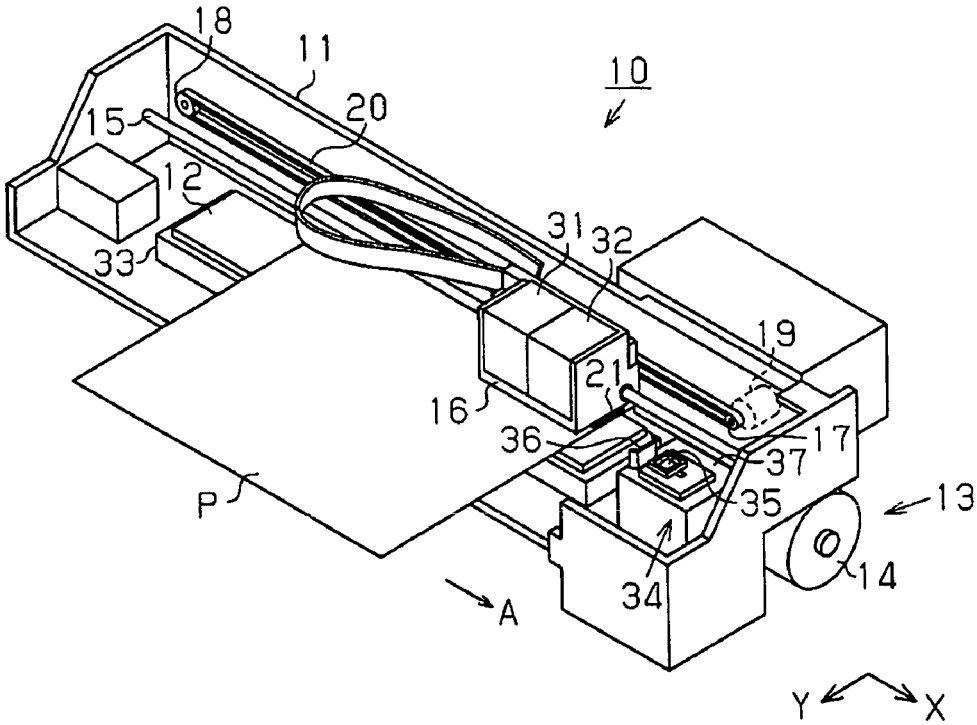
FIG. 1 is a perspective view illustrating a printer.

As shown in FIG. 1, a printer 10, or a liquid ejection apparatus of the illustrated embodiment, includes a substantially box-like frame 11. A platen 12 is provided in a lower part of the space defined by the frame 11. The platen 12 extends in a longitudinal direction of the frame 11 (main scanning direction X shown in FIG. 1). The platen 12 functions as a support table that supports a sheet of paper P, or a target. The platen 12 is driven by a paper feeder motor 14, which is provided in a paper feeder mechanism 13, and sends the paper sheet P in a sub-scanning direction Y perpendicular to the main scanning direction X.

A guide shaft 15 is arranged in the frame 11 and extends above the platen 12. The guide shaft 15 is passed through a carriage 16 to movably support the carriage 16. A drive pulley 17 and a driven pulley 18 are rotatably supported by the frame 11 at positions corresponding to opposing ends of the guide shaft 15. A carriage motor 19 is connected to the drive pulley 17. A timing belt 20, which is coupled to the carriage 16, is wound around the pulleys 17, 18. The carriage 16 is thus moved in the main scanning direction X through the timing belt 20 while driven by the carriage motor 19 and guided by the guide shaft 15.

Figure 2:
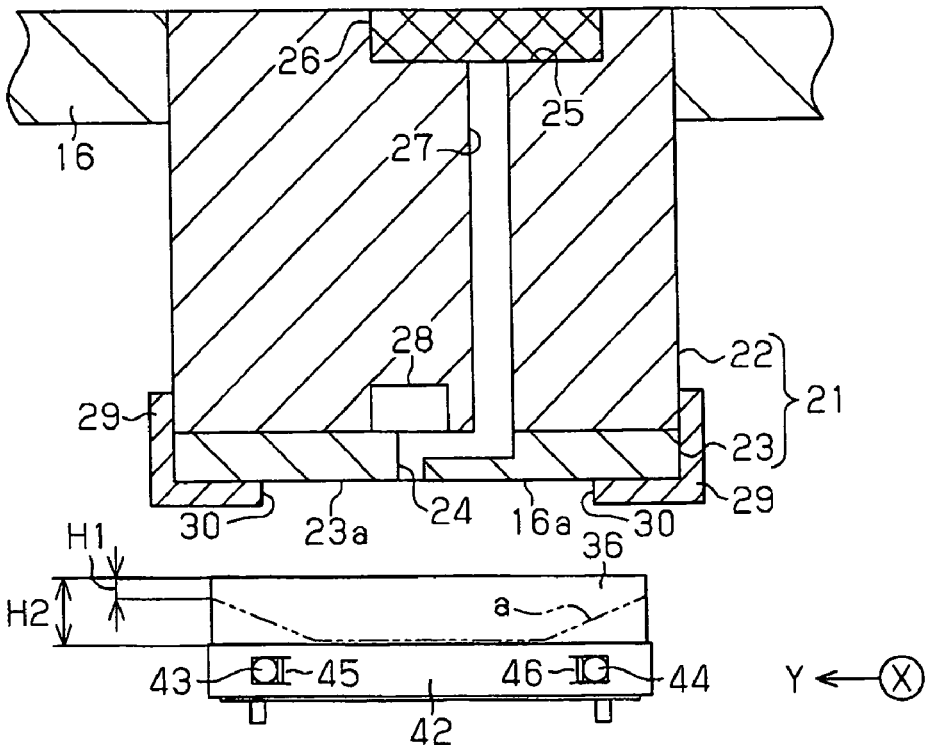
FIG. 2 is a cross-sectional side view showing the relative positions of a recording head and a wiper member provided in the printer of FIG. 1.
Figure 3:
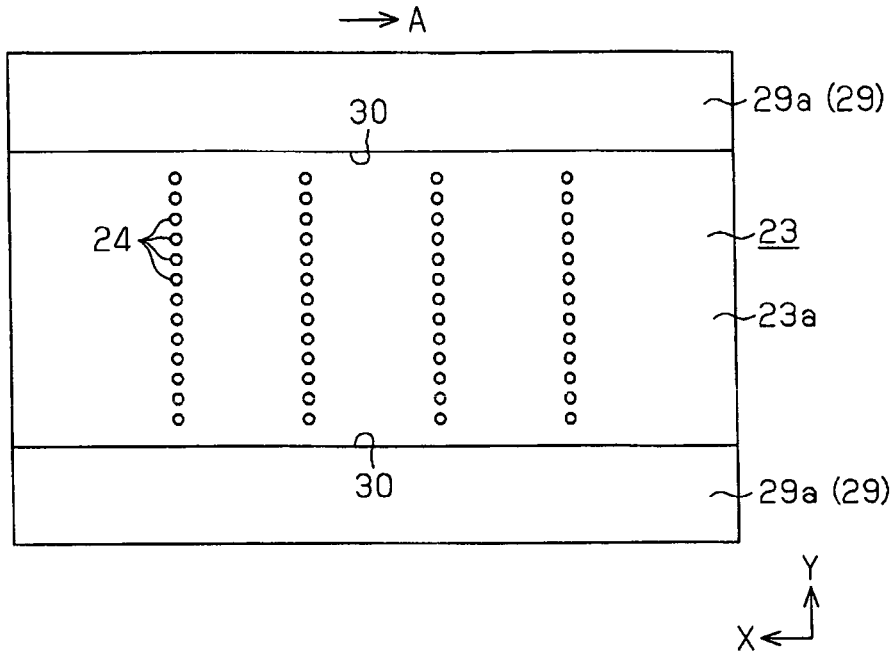
FIG. 3 is a bottom view showing the recording head provided in the printer of FIG. 1.

A recording head 21, or a liquid ejection head, is formed on a bottom surface of the carriage 16. As shown in FIG. 2, the recording head 21 includes a head case 22 and a nozzle plate 23. The head case 22 is substantially shaped like a rectangular parallelepiped and attached to the lower surface of the carriage 16. The nozzle plate 23 is attached (bonded) to the lower surface of the head case 22. As shown in FIG. 3, a plurality of nozzle openings 24 are defined in a nozzle surface 23*a*, which is a lower surface of the nozzle plate 23. The nozzle openings 24 are arranged at constant intervals with respect to the main scanning direction X, in such a manner as to form nozzle lines (the number of which is four in FIG. 3), each extending along the sub-scanning direction Y.

The nozzle surface 23*a* is treated with water repellent plating. Although FIG. 3 illustrates a great number of (fifty-two in FIG. 3) of the nozzle openings 24 forming four nozzle lines, FIG. 2 only shows one of the nozzle openings 24 for purposes of illustration.

As shown in FIG. 2, recesses 25 are formed on the upper surface of the head case 22. A filter 26 for removing foreign matter from ink (liquid) is provided in each recess 25. Also, ink channels 27 (only one of them is shown in FIG. 2) are formed in the head case 22 and the nozzle plate 23. Each ink channel 27 connect one of the recesses 25 with a corresponding one of the nozzle openings 24. Each ink channel 27 forms a part of an ink ejection nozzle. Piezoelectric elements 28, each of which corresponds to one of the ink channels 27, are also arranged in the head case 22. Through excitement of the piezoelectric elements 28, ink is ejected from each nozzle 25 onto the paper sheet P that has reached the position below the recording head 21.

As shown in FIGS. 2 and 3, a pair of head covers 29 are attached to the lower portion of the recording head 21. The head covers 29 contacts side surface of the head case and extend along the main scanning direction X. The head covers 29 have an L-shaped cross-section as viewed from the side. Each head cover 29 has a support portion 29*a* that extends horizontally along the nozzle surface 23*a* of the nozzle plate 23. The support portions 29*a* support the nozzle plate 23, which is bonded to the lower surface of head case 22, from below. This construction prevents the nozzle plate 23 from coming off the head case 22. The support portions 29*a* define two steps 30 on the nozzle surface 23*a* of the recording head 21, along a direction in which the carriage 16 is moved, or along the main scanning direction X.

As shown in FIG. 1, Ink cartridges 31, 32 are separably held in the carriage 16 and thus supply ink to the recording head 21. For example, the ink cartridge 31 on the left as viewed in FIG. 1 supplies ink to the nozzle openings 24 that form the left two nozzle lines among the four nozzle lines shown in FIG. 3 through the corresponding recesses 25 and ink channels 27. Likewise, the ink cartridge 32 on the right as viewed in FIG. 1 supplies ink to the nozzle openings 24 that form the right two nozzle lines among the four nozzle lines shown in FIG. 3 through the corresponding recesses 25 and ink channels 27.

A waste tank 33, which extends parallel with the platen 12, is provided below the platen 12 in the frame 11. The waste tank 33 accommodates an absorptive body (not shown) formed of, for example, porous pulp material. Thus, when cleaning or wiping is performed in a known manner, ink collected on the nozzle surface 23*a* of the nozzle plate 23 is drained into the waste tank 33 and absorbed by the absorptive body.

On the other hand, a maintenance unit 34 having a wiping device and a cleaning device is arranged in an end portion of the printer 10 in the longitudinal direction, which is a non-printing area into which the paper sheet P does not proceed. The maintenance unit 34 has a cap 35 (cleaning device) and a suction pump 37 (cleaning device). The cap 35 seals the nozzle surface 23*a* of the recording head 21, and the suction pump 37 is driven to generate negative pressure in the cap 35 and thus forcibly draws ink collected on areas about the nozzle openings 24. The maintenance unit 34 has a wiping device, which includes a wiper member 36. The wiper member 36 wipes off ink collected on the nozzle surface 23*a* of the recording head 21.

The cap 35 is movable in the vertical direction by means of a known lift mechanism (not shown). When raised, the cap 35 contacts the nozzle surface 23*a* of the recording head 21. Accordingly, the cap 35 seals the nozzle surface 23*a*, creating a sealed space between the inner surface of the cap 35 and the nozzle surface 23*a*.

Likewise the wiper member 36 is movable in the vertical direction by means of a known lift mechanism (not shown). When wiping is performed, the wiper member 36 and the recording head 21 (the carriage 16) are moved relative to each other in the main scanning direction X in a state where the wiper member 36 slightly overlaps the nozzle surface 23*a* of the recording head 21. That is, the recording head 21 (the carriage 16) is moved in a direction opposite to the wiping direction (direction A in FIGS. 1 and 3) along the main scanning direction X, so that the wiper member 36 slides on the nozzle surface 23*a* while the distal end (the upper end) of the wiper member 36 is flexed. Accordingly, when sliding, the wiper member 36 wipes the nozzle surface 23*a*.

Next, the wiping device, which is a main part of the present invention, will now be described while focusing on the construction of the wiper member 36.

Figure 4A:
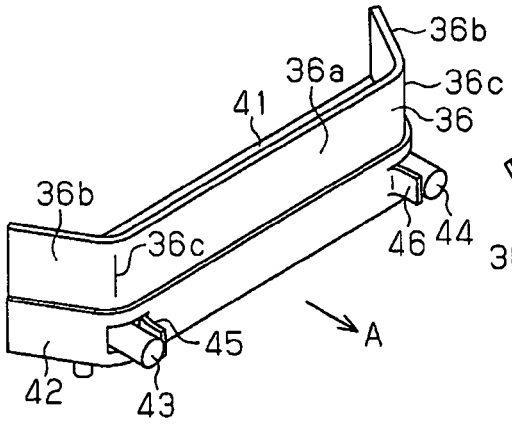
FIG. 4A is a perspective view illustrating a wiping device according to a first embodiment.
Figure 4B:
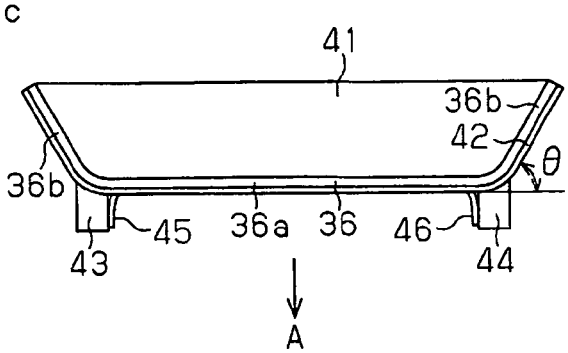
FIG. 4B is a plan view showing the wiping device of FIG. 4A.

As shown in FIGS. 4A and 4B, the wiper member 36 has a straight portion 36*a*, which corresponds to a second portion, and bent portions 36*b*, which correspond to a first portion. The straight portion 36*a* is formed of a flexible material such as elastomer. The straight portion 36*a* is formed as a rectangular plate and extends in a direction perpendicular to the wiping direction (direction A) as described above. The bent portions 36*b* expand in a spreading manner from the ends of the straight portion 36*a* in a direction opposite to the wiping direction.

That is, when the wiping direction (direction A in FIG. 4) is defined as the forward direction, the bent portions 36*b* are located rearward of the straight portion 36*a*. Also, the bent portions 36*b* continuously formed from the ends of the straight portion 36*a* to extend diagonally backward with respect to the wiping direction. Fold lines 36*c*, which are boundaries between the straight portion 36*a* and the bent portions 36*b*, are located slightly inward of the steps 30 on the nozzle surface 23*a*, that is, slightly closer to the center in the longitudinal direction of the wiper member 36. The bent portions 36*b* are symmetrical with respect to the longitudinal center of the wiper member 36, and the bending angle è of each bent portion 36*b* relative to the straight portion 36*a* is 60 degrees. The position of the straight portion 36*a* corresponds to the area on the nozzle surface 23*a* where the nozzle openings 24 are formed, and the positions of the bent portions 36*b* correspond to the steps 30 on the nozzle surface 23*a*.

The wiper member 36 is fixed to a base 41 by means of a wiper holder 42. The base 41 is provided in the maintenance unit 34 to be movable in the vertical direction. Specifically, two projections 43, 44 are provided on a side of the base 41 that faces the wiper member 36. The projections 43, 44 project in the wiping direction (direction A). The wiper member 36 has through holes (not shown) for receiving the projections 43, 44.

The wiper member 36 is held between the base 41 and the wiper holder 42. The wiper holder 42 is a plate spring that is curved to conform to the shape of the wiper member 36. Portions of the wiper holder 42 that correspond to the projections 43, 44 of the base 41 are cut such that the cutout portions function as elastic pieces 45, 46. The projections 43, 44 of the base 41 are passed through the through holes of the wiper member 36 and the cutout portions of the wiper holder 42, respectively. Accordingly, free ends of the elastically deformed elastic pieces 45, 46 press the projections 43, 44, so that the wiper member 36 is held between the base 41 and the wiper holder 42.

The wiping operation of the printer 10 will now be described.

When starting wiping, the carriage 16 is moved to a position above the cap 35 of the maintenance unit 34. Then, the wiper member 36 is raised to the lift device (not shown) to a position where the distal end (upper end) slightly overlaps the nozzle surface 23*a* of the recording head 21 in the vertical direction. In this state, when the recording head 21 (carriage 16) moves along the main scanning direction X in a direction opposite to the wiping direction (direction A), the distal end (upper end) of the wiper member 36 slides on and wipes the nozzle surface 23*a*.

At this time, the wiper member 36 is flexed while being bent at a fold line a shown by a two-dot chain line in FIG. 2. That is, the straight portion 36*a* are flexed in the moving direction of the carriage 16 (direction opposite to the direction A), or from the front toward the rear along the wiping direction, in the horizontal section of the fold line a. Also, at inclined portions of the fold line a, the bent portions 36*b* are flexed from the front toward the rear along the wiping direction in the manner falling toward the longitudinal center of the wiper member 36. As a result, as shown in FIG. 2, the length H1 from the fold line a of the proximal end in each bent portion 36*b*, or the bent position, to the distal end of the wiper member 36 (distal end in the vertical direction) is shorter than the length H2 from the fold line a in the straight portion 36*a*, or the bent position, to the distal end of the wiper member 36.

The wiping force produced when the distal end of the wiper member 36 slides on and wipes the nozzle surface 23*a*, that is, the reaction force of the wiper member 36 acting in a direction opposite to the moving direction of the carriage 16, is increased as the length from the fold line a of the proximal end to the distal end in the state where the wiper member 36 is flexed becomes shorter. Therefore, when the wiper member 36 is flexed during the wiping operation, the reaction force (wiping force) acting in the direction opposite to the moving direction of the carriage 16 is greater in the bent portions 36*b* than in the straight portion 36*a*. Therefore, the bent portions 36*b* of the wiper member 36 wipes the steps 30 of the nozzle surface 23*a* by a greater wiping force than the straight portion 36*a*.

The above embodiment has the following advantages.

In the wiper member 36 according to the above embodiment, the bent portions 36*b*, the bent portions 36*b*, which correspond to the steps 30 on the nozzle surface 23*a*, generate a greater wiping force (reaction force), which corresponds to restoring force generated due to flexing during the wiping operation, than the straight portion 36*a*, which corresponds to the area of the nozzle openings 24 on the nozzle surface 23*a*. Therefore, during the wiping operation, the bent portions 36*b* wipe the steps 30 of the nozzle surface 23*a* by a greater wiping force than the straight portion 36*a*. Therefore, ink does not remain unwiped at the steps 30 defined by the support portions 29*a* on the nozzle surface 23*a*. That is, the entire nozzle surface 23*a* is readily and reliably wiped.

(2) The wiper member 36 is structured such that the wiping force of the bent portions 36*b* corresponding to the steps 30 is greater than the other portions, so that the wiping force of the straight portion 36*a* is not excessive. Therefore, the water-repellent plating on the nozzle surface 23*a* is not removed by the pressing force (wiping force) applied to the nozzle surface 23*a* by the straight portion 36*a*. Further, during the wiping operation, the sliding resistance between the wiper member 36 and the nozzle surface 23*a* is not excessively increased. Accordingly, the driving load generated when the recording head 21 and the wiper member 36 are moved relative to each other is not increased.

Figure 5A:
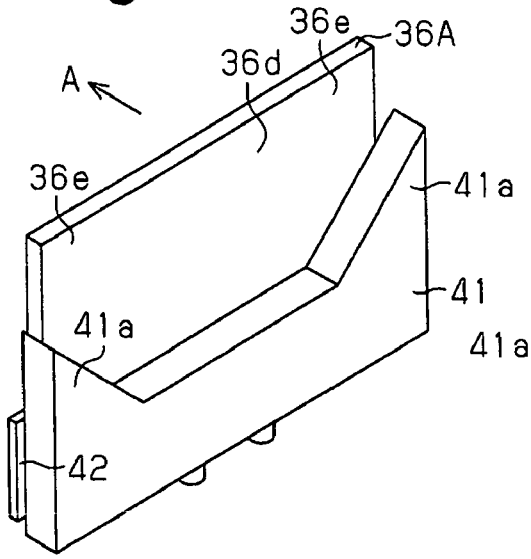
FIG. 5A is a perspective view illustrating a wiping device according to a second embodiment.

A second embodiment of the present invention will now be described with reference to FIGS. 5A and 5B. Since the main component of a printer 10 according to the present embodiment are the same as those of the first embodiment, redundant descriptions for such components will be omitted, and only the components that are different from the first embodiment will be explained in detail.

Like the wiper member 36 according to the first embodiment, a wiper member 36A according to the present embodiment is tightly held between a wiper holder 42 and a base 41. However, unlike the wiper member 36 of the first embodiment, the wiper member 36A of this embodiment has no bent portions in the longitudinal-direction, but is formed as a flat plate. Portions of the base 41 that correspond to end portions 36*e* of the wiper member 36A are gradually raised from the longitudinal center of the base 41 toward the edges. That is, the base 41 of this embodiment has projections 41*a*, which are triangular as viewed from a side, at longitudinal ends.

In this embodiment, when the wiper member 36A is flexed in a direction opposite to the wiping direction, the ends of the base 41 function as contact members that contact the proximal portion of the wiper member 36A. In this embodiment, the end portions 36*e* of the wiper member 36A correspond to a first portion, and the center portion 36*d* of the wiper member 36A corresponds to a second portion.

Figure 5B:
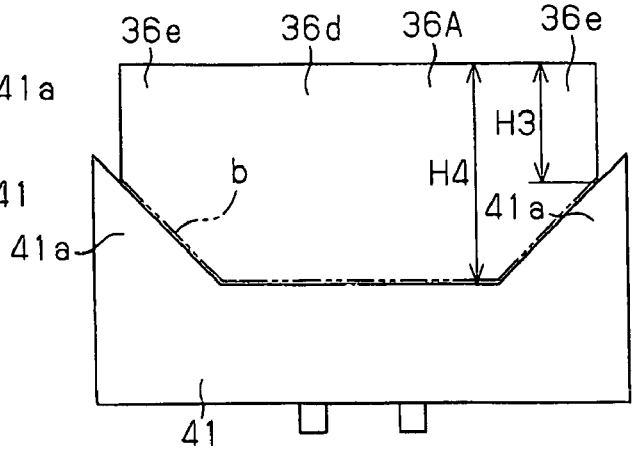
FIG. 5B is a side view showing the wiping device of FIG. 5A.

In this embodiment, when, at the beginning of the wiping operation, the recording head 21, or the carriage 16, is moved in a direction opposite to the wiping direction (direction A) along the main scanning direction X, the wiper member 36A is flexed in a manner being bent along a fold line b shown by two-dot chain line in FIG. 5B along the upper edge of the base 41. That is, the center portion 36*d* of the wiper member 36A is flexed in the moving direction of the carriage 16 (direction opposite to the direction A) at the horizontal section of fold line b. Also, the end portions 36*e* of the wiper member 36A are flexed in the moving direction of the carriage 16 at the inclined sections of fold line b.

The wiper member 36A is formed such that, at each end portion 36*e*, the distance from the fold line b to the distal end (for example, the length H3 at the end (see FIG. 5B)), is shorter than the length H4 from the fold line b to the distal end at the center portion 36*d*.

Therefore, when the wiper member 36A is flexed during the wiping operation, the reaction force (wiping force) acting in the direction opposite to the moving direction of the carriage 16 is greater in the end portions 36*e* than in the center portion 36*d*. Therefore, the end portions 36*e* of the wiper member 36A wipe the steps 30 of the nozzle surface 23*a* by a greater wiping force than the center portion 36*d*.

In addition to the advantages (1) and (2) of the first embodiment, the second embodiment provides the following advantages.

(3) The projections 41*a* are formed in portions of the base 41 that correspond to end portions 36*e* of the wiper member 36A, and the projections 41*a* are gradually raised from the longitudinal center toward the edges. The distal end of the base 41 defines the fold line b at the time of the wiping operation of he wiper member 36A, or a bent position. At each end portion 36*e*, the length H3 from the fold line b to the distal end is shorter than the length H4 from the fold line b to the distal end at the center portion 36*d*.

That is, in the wiper member 36A, the end portions 36*e*, which correspond to the steps 30 on the nozzle surface 23*a*, generate a greater wiping force (reaction force), which corresponds to restoring force generated due to flexing during the wiping operation, than the center portion 36*d*, which corresponds to the area of the nozzle openings 24 on the nozzle surface 23*a*. Therefore, the wiper member 36A, which has a simple structure formed by adding the projections 41*a* to the ends of a conventional plate-like wiper member, readily and reliably wipes the entire nozzle surface 23*a*, on which the steps 30 are formed.

A third embodiment will now be described using FIG. 6. Since the main component of a printer 10 according to the present embodiment are the same as those of the first embodiment, redundant descriptions for such components will be omitted, and only the components that are different from the first embodiment will be explained in detail.

Like the wiper member 36A according to the second embodiment, a wiper member 36B according to the present embodiment has no bent portions with respect to the longitudinal direction, but is formed as a flat plate as a whole. Also, like the wiper member 36 according to the first embodiment, the wiper member 36B according to the present embodiment is tightly held between a wiper holder 42 and a base 41. However, the wiper member 36B according to the present embodiment has rectangular cutout portions 36*f* at longitudinal ends, and the height of the end portions 36*e* is less than that of the center portion 36*d*. In this embodiment, the end portions 36*e* of the wiper member 36B correspond to a first portion, and the center portion 36*d* of the wiper member 36B corresponds to a second portion.

Figure 6:
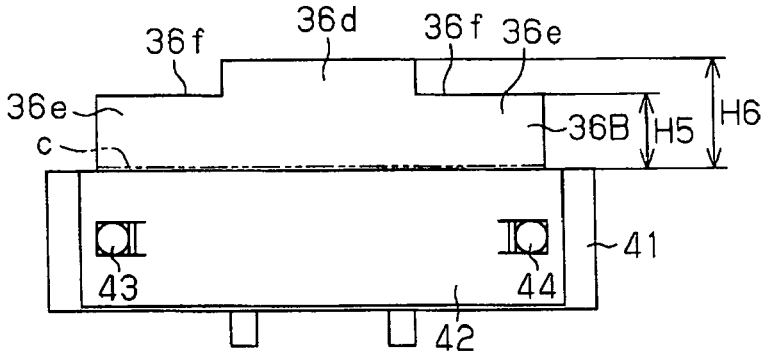
FIG. 6 is a side view illustrating a wiping device according to a third embodiment.

In this embodiment, when, at the beginning of the wiping operation, the recording head 21, or the carriage 16, is moved in a direction opposite to the wiping direction (direction A) along the main scanning direction X, the wiper member 36B is flexed in a manner being bent along a fold line c shown by two-dot chain line in FIG. 6 along the upper edge of the base 41. That is, in any section in the center portion 36*d* and the end portions 36*e*, the wiper member 36B is flexed in the moving direction of the carriage 16 at the horizontal fold line c extending along the upper edge of the base 41.

The wiper member 36B is formed such that, at each end portion 36*e*, the length H5 (see FIG. 6) from the fold line c, or a bent position, to the distal end is shorter than the length H6 (see FIG. 6) from the fold line c to the distal end at the center portion 36*d*.

Therefore, when the wiper member 36B is flexed during the wiping operation, the reaction force (wiping force) acting in the direction opposite to the moving direction of the carriage 16 is greater in the end portions 36*e* than in the center portion 36*d*. Therefore, the end portions 36*e* of the wiper member 36B wipe the steps 30 of the nozzle surface 23*a* by a greater wiping force than the center portion 36*d*.

In addition to the advantages (1) and (2) of the first embodiment, the third embodiment provides the following advantages.

(4) In the present embodiment, the nozzle surface 23*a* is wiped by the wiper member 36B, which has the rectangular cutout portions 36*f* at the end portions in the longitudinal direction. That is, at each end portion 36*e* of the wiper member 36B, the length H5 from the fold line c to the distal end is shorter than the length H6 from the fold line c to the distal end at the center portion 36*d*.

Therefore, in the wiper member 36B, the end portions 36*e*, which correspond to the steps 30 on the nozzle surface 23*a*, generate a greater wiping force (reaction force), which corresponds to restoring force generated due to flexing during the wiping operation, than the center portion 36*d*, which corresponds to the area of the nozzle openings 24 on the nozzle surface 23*a*. Therefore, the wiper member 36B, which has a simple structure formed by providing the cutout portions 36*f* to the ends in the longitudinal direction of a conventional plate-like wiper member, readily and reliably wipes the entire nozzle surface 23*a*, on which the steps 30 are formed.

A fourth embodiment of the present invention will now be described with reference to FIGS. 7A and 7B. Since the main component of a printer 10 according to the present embodiment are the same as those of the first embodiment, redundant descriptions for such components will be omitted, and only the components that are different from the first embodiment will be explained in detail.

Like the wiper members 36A, 36B according to the second and third embodiments, a wiper member 36C according to the present embodiment has no bent portions with respect to the longitudinal direction, but is formed as a flat plate as a whole. Also, like the wiper members 36, 36A, 36B according to the above embodiments, the wiper member 36C according to the present embodiment is tightly held between a wiper holder 42 and a base 41.

Figure 7A:
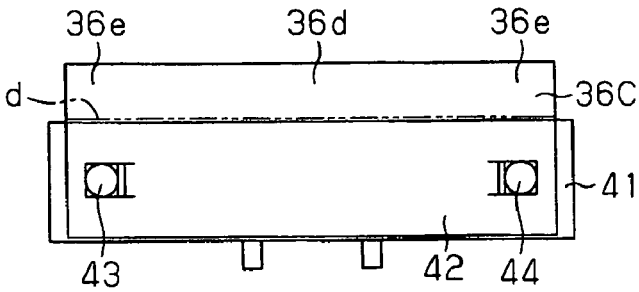
FIG. 7A is a side view illustrating a wiping device according to a fourth embodiment.
Figure 7B:
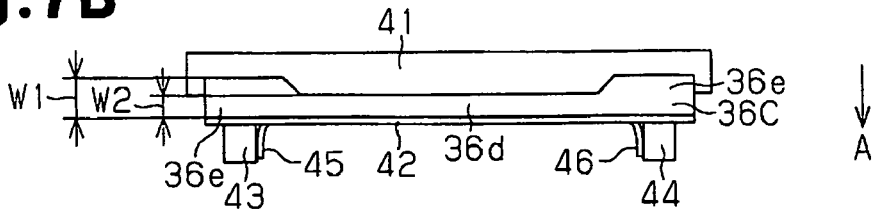
FIG. 7B is a plan view showing the wiping device of FIG. 7A.

However, the thickness W1 of each end portion 36*e* in the longitudinal direction of the wiper member 36C is greater than the thickness W2 of the center portion 36*d* as show in FIG. 7B. In this embodiment, the end portions 36*e* of the wiper member 36C correspond to a first portion, and the center portion 36*d* of the wiper member 36C corresponds to a second portion.

In this embodiment, when, at the beginning of the wiping operation, the recording head 21, or the carriage 16, is moved in a direction opposite to the wiping direction (direction A) along the main scanning direction X, the wiper member 36C is flexed in a manner being bent along a fold line d shown by two-dot chain line in FIG. 7A along the upper edge of the base 41. That is, in any section in the center portion 36*d* and the end portions 36*e*, the wiper member 36C is flexed in the moving direction of the carriage 16 at the horizontal fold line d extending along the upper edge of the base 41.

Since the thickness at each end portion 36*e* is greater than that in the center portion 36*d*, the wiper member 36C has a greater rigidity at the end portions 36*e* than in the center portion 36*d*. Therefore, the flexing amount in the moving direction of the carriage 16 of the wiper member 36C at the end portions 36*e* is less than the flexing amount in the moving direction of the carriage 16 of the center portion 36*d*.

Therefore, when the wiper member 36C is flexed during the wiping operation, the reaction force (wiping force) acting in the direction opposite to the moving direction of the carriage 16 is greater in the end portions 36*e* than in the center portion 36*d*. Therefore, the end portions 36*e* of the wiper member 36C wipe the steps 30 of the nozzle surface 23*a* by a greater wiping force than the center portion 36*d*.

In addition to the advantages (1) and (2) of the first embodiment, the fourth embodiment provides the following advantages.

(5) In this embodiment, the wiper member 36C, in which the thickness W1 of the end portions 36*e* is greater than the thickness W2 of the center portion 36*d*, is used for wiping the nozzle surface 23*a*. Therefore, in the wiper member 36C, the end portions 36*e*, which correspond to the steps 30 on the nozzle surface 23*a*, generate a greater wiping force (reaction force), which corresponds to restoring force generated due to flexing during the wiping operation, than the center portion 36*d*, which corresponds to the area of the nozzle openings 24 on the nozzle surface 23*a*. Therefore, the entire nozzle surface 23*a*, on which the steps 30 are defined, is readily and reliably wiped by a simple structure in which the thickness W1 of the end portions 36*e* is increased.

The above illustrated embodiments may be modified as follows.

In the first embodiment, the bending angle θ of each bent portion 36*b* is 60 degrees. However, the bending angle θ may be changed as necessary. Also, the straight portion 36*a* may be replaced by a gently curved portion, and the bent portions 36*b* may be curved to be smoothly continued from the ends of the curved portion.

In the second embodiment, the projections 41*a* may be constructed by members separately formed from the base 41. Also, the wiper member 36A may be tightly held between two bases 41, each having projections 41*a*.

In the illustrated embodiments, the wiping operation may be executed by moving the wiper member 36, 36A, 36B, 36C relative to the carriage 16 in the wiping direction (direction A). That is, when the wiping operation is performed, it is only necessary to move either of the wiper member and the carriage 16 relative to the other.

The configurations of the illustrated embodiments may be combined as necessary. For example, the characteristic features of the wiper member 36C according to the fourth embodiment may be applied to any of the first to third embodiments. That is, the configuration in which the thickness W1 of the end portions 36*e* is different from the thickness W2 of the center portion 36*d* may be applied to the first to third embodiments.

By combining the configurations that makes the wiping force at the end portions of the wiper member 36, 36A, 36B, 36C greater than the wiping force of the center portion 36*d*, the steps 30 on the nozzle surface 23*a* are reliably wiped.

The present invention may be applied to a recording head having steps that are defined by members other than the support portions 29*a* of the head cover 29.

The present invention may be applied to a recording head 21 that has one step or three or more steps. In this case, the wiper member has one or three or more portions that correspond to the steps.

The present invention may be applied to a recording head in which steps 30 extend along the sub-scanning direction Y. In this case, the wiping direction of the wiper member agrees with the sub-scanning direction Y.

In the illustrated embodiment, the present invention is applied to the on-carriage type inkjet printers in which the ink cartridges 31, 32 are installed in the carriage 16. However, the present invention is applicable also to an off-carriage type inkjet printer.

In the above illustrated embodiment, the present invention is applied to the printer 10, which ejects ink. However, the present invention may be applied to other types of liquid ejection apparatuses. For example, the present invention may be applied to printing machines including fax machines and copy machines, a liquid ejecting apparatus for ejecting liquid such as electrode material or color material used for manufacturing liquid crystal displays, electro luminescent displays and surface light emitting displays. The present invention may also be applied to liquid ejecting apparatus for ejecting biological organic matter used for manufacturing biochips. Alternatively, the present invention may be applied to sample ejecting apparatus such as a precision pipette.

The present examples and embodiments are to be considered as illustrative and not restrictive and the invention is not to be limited to the details given herein, but may be modified within the scope and equivalence of the appended claims.

The invention claimed is:

1. A wiper device that wipes a nozzle surface of a liquid ejection head along a wiping direction, the nozzle surface having a plurality of nozzle openings for ejecting liquid and a step, wherein the step is located outside of an area in which the nozzle openings are provided and extends along the wiping direction, the wiper device comprising:

a wiper member for wiping the nozzle surface along the wiping direction, wherein the wiper member has a first portion corresponding to the step and a second portion corresponding to the area in which the nozzle openings are provided, wherein the first portion extends rearward of the wiping direction from the second portion in such a manner as to intersect the wiping direction, so that a wiping force for wiping the nozzle surface of the first portion is greater than that of the second portion.

2. The wiper device according to claim 1, wherein the wiper member is bent at a predetermined position when sliding on the nozzle surface during the wiping operation, and wherein a length from the bent position to a distal end of the wiper member is shorter in the first portion than in the second portion.

3. The wiper device according to claim 1, wherein the second portion linearly extends in a direction perpendicular to the wiping direction.

4. The wiper device according to claim 1, wherein the step is one of a pair of steps provided at both sides of the nozzle openings, and the first portion is one of a pair of first portions extending from both sides of the second portion, wherein the second portion is formed as a rectangular plate and extends in a direction perpendicular to the wiping direction, and the first portions expand in a spreading manner from the ends of the second portion in a direction opposite to the wiping direction.

5. The wiper device according to claim 4, further comprising a base and a wiper holder, wherein the wiper holder is curved to conform to the shape of the wiper member, wherein the wiper member is fixed to the base by means of the wiper holder.

6. The wiper device according to claim 5, wherein the base has a projection provided on a side of the base that faces the wiper member, wherein the wiper holder has an elastic cutout portion formed by cutting a portion of the base corresponding to the projection, wherein, in a state that the wiper member is held between the base and the wiper holder, the elastic cutout portion presses the projection to that the wiper member is fixed to the base by means of the wiper holder.

7. A liquid ejection apparatus comprising:

a liquid ejection head having a nozzle surface, the nozzle surface having a plurality of nozzle openings for ejecting liquid and a step, wherein the step is located outside of an area in which the nozzle openings are provided and extends along a predetermined direction; and a wiper member for wiping the nozzle surface along a wiping direction parallel with the predetermined direction, wherein the wiper member has a first portion corresponding to the step and a second portion corresponding to the area in which the nozzle openings are provided, wherein the first portion extends rearward of the wiping direction from the second portion in such a manner as to intersect the wiping direction, so that a wiping force for wiping the nozzle surface of the first portion is greater than that of the second portion.

8. The liquid ejection apparatus according to claim 7, wherein the wiper member is bent at a predetermined position when sliding on the nozzle surface during the wiping operation, and wherein a length from the bent position to a distal end of the wiper member is shorter in the first portion than in the second portion.

9. The liquid ejection apparatus according to claim 7, wherein the second portion linearly extends in a direction perpendicular to the wiping direction.

10. The liquid ejection apparatus according to claim 7, wherein the step is one of a pair of steps provided at both sides of the nozzle openings, and the first portion is one of a pair of first portions extending from both ends of the second portion, wherein the second portion is formed as a rectangular plate and extends in a direction perpendicular to the wiping direction, and the first portions expand in a spreading manner from the ends of the second portion in a direction opposite to the wiping direction.

11. The liquid ejection apparatus according to claim 10, further comprising a base and a wiper holder, wherein the wiper holder is curved to conform to the shape of the wiper member, wherein the wiper member if fixed to the base by means of the wiper holder.

12. The liquid ejection apparatus according to claim 11, wherein the base has a projection provided on a side of the base that faces the wiper member wherein the wiper holder has an elastic cutout portion formed by cutting a portion of the base corresponding to the projections, wherein, in a state that the wiper member is held between the base and the wiper holder, the elastic cutout portion presses the projection so that the wiper member is fixed to the base by means of the wiper holder.

* * * * *